US006089924A

United States Patent [19]

Wang

[11] Patent Number: 6,089,924

[45] Date of Patent: Jul. 18, 2000

[54] FLAT PLUG STRUCTURE

[76] Inventor: Peace Wang, No. 111-4, Lane 167, Tsyr-Shiou N. Road, Chang-Hua, Taiwan

[21] Appl. No.: 09/181,654

[22] Filed: Oct. 29, 1998

[51] Int. Cl.[7] ..... H01R 13/04; H01R 13/00

[52] U.S. Cl. ..... 439/694; 439/484

[58] Field of Search ..... 439/694, 692, 439/483, 484, 474, 475, 597, 601, 172, 103, 107, 599, 92, 628, 135, 602, 21, 491

[56] References Cited

U.S. PATENT DOCUMENTS 4,927,376 5/1990 Dickie ..... 439/484

5,863,364 1/1999 Lin ..... 156/73.1

*Primary Examiner*—Neil Abrams

*Assistant Examiner*—Chandrika Prasad

*Attorney, Agent, or Firm*—Birch, Stewart, Kolasch & Birch, LLP

[57] ABSTRACT

A flat plug structure including a base, a cover, a bent guide element, a semi-circular fastening ring, and two electrical conductive insert pins. The base and the cover are symmetrical circular plates, each having one side provided with an I-shaped groove for receiving the bent guide element, the opposite side being provided with a cut planar face. The base is provided with symmetrical recessed portions on left and right sides thereof. An inner end of each recessed portion is provided with a through hole for receiving the two electrical conductive insert pins, and a lower end thereof is provided with a deeper groove that extends to the I-shaped groove. A plurality of posts are provided in the recessed portion. The base or the cover is provided with a slightly projecting ring at an edge thereof, and high frequencies can be used to couple the base, the cover, the bent guide element, and the two electrical conductive insert pins together. The base and the cover are further provided with recesses for receiving and positioning the semi-circular fastening ring.

3 Claims, 5 Drawing Sheets

FLAT PLUG STRUCTURE

BACKGROUND OF THE INVENTION (a) Field of the Invention

The present invention relates to a flat plug structure.

(b) Description of the Prior Art

FIG. 8 shows a typical conventional plug 1. As shown, the plug 1 includes a holding portion 2 and a bendable portion 3 at a rear end thereof. A structure as such has a considerable length. When the plug 1 is plugged into a socket 4, the rear end of the plug 1 will project a certain distance from the socket 4 or the wall surface, so that it is not possible to place furniture items or articles close against the wall where the plug 1 and the socket 4 are, which is not very convenient in arrangement of furniture. Furthermore, if the plug 1 projects from the socket 4 too much, according to the principle of force dynamics, the weight of the plug 1 and the wire will cause the rear end of the plug to droop or even drop. Besides, the projecting plug will obstruct passage of people.

There has been developed a type of flat plug. Referring to FIG. 9, a flat plug 5 lies close against the socket 4, and the wire 6 at its rear end will not project from the socket 4 or the wall surface as the plug 1 in FIG. 8. As this type of plug has better grasping force and does not affect the arrangement of furniture or articles, it is quite popular with consumers. However, a problem with a plug as such is that it is made by plastic extrusion. In plastic extrusion, the components are placed orderly into a mold manually, and the mold is then closed to proceed with extrusion. The manufacturing speed is quite slow, and production bottleneck may easily occur. In particular, as the planar area of the flat plug 5 is relatively large, in order not to affect use of other plugs, a rear end 7 thereof extends towards one side thereof and bends downwardly, as shown in FIG. 9. The rear end of the wire 6 must have a section embedded in the flat plug 5, and the embedded portion is just where the rear end 7 bends with respect to the flat plug 5. Therefore, the securing of the wire at the bent portion prior to extrusion is not easy. Although the mold may be configured to have posts to position the wire, this not only retards production speed but also affects the appearance of the plug and is likely to result in faulty products.

SUMMARY OF THE INVENTION

A primary object of the present invention is to provide a flat plug that is quick and inexpensive to manufacture.

According to one aspect of the present invention, a flat plug comprises:

a base that is a substantially circular plate, one side of the base extending to form a tail portion provided with an I-shaped groove, the opposite side being provided with a cut planar face, and the other two sides being respectively provided with a notch at an edge thereof, the notch including a relatively small semi-circular depression in a middle portion thereof, and a relatively large semi-circular depression recess at an inner side thereof, the base further having recessed portions on both sides thereof, said recessed portions each being provided with a through hole on an inner side thereof, one of the recessed portions being deeper than the other and extending to said I-shaped groove, a plurality of posts extending upwardly from said recessed portions, the edge of the base being further provided with a slightly projecting ring;

a cover that is a substantially circular plate resembling the profile of the base, one side of the cover extending to form a tail portion provided with an I-shaped groove, the opposite side being provided with a cut planar face at an edge thereof and a depressed portion along a periphery of the planar portion, two sides of the cover being provided with notches that are symmetrical with those of the base, the notches having cavities disposed therein to match the posts of the base;

a bent guide element that is secured with a wire integrally, the bent guide element having a front end provided with an annular groove that may just fit into the I-shaped grooves of the base and the cover so that they can be secured as a whole, a central portion of the bent guide element being bent about 45 degrees and provided with a determined number of annular grooves to enhance its suppleness;

two electrical conductive insert pins that are punched and bent from steel sheets, the electrical conductive insert pins each including a horizontal plate portion, a downwardly bent vertical pin portion, and a wire securing seat, the horizontal plate portions being respectively provided with holes, the electrical conductive insert pins just fitting into the two recessed portions of the base respectively such that the vertical pin portions respectively pass through the through holes of the base with the posts respectively passing through holes of the horizontal plate portions, the wire being embedded in the deeper grooves between the recessed portions and the I-shaped groove of the base; and a semi-circular fastening ring that has two ends bending inwardly to form flat portions at rear ends thereof, the two ends being inserted into the holes defined by the notches on both sides of the base and the cover after the base, the cover, and the bent guide element are fused together as a whole using high frequencies, thus achieving a flat plug.

According to another aspect of the present invention, the base is provided with a plurality of posts, and the cover is provided with corresponding cavities for receiving the posts, whereby the base and the cover may be fused using high frequencies.

According to a further aspect of the present invention, the base or the cover may be provided with a suitable number of fusion points so that the cover and the base may be firmly fused together.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and other features and advantages of the present invention will be more clearly understood from the following detailed description and the accompanying drawings which are given by way of illustration only, and thus are not limitative of the present invention, and in which.

DETAILED DESCRIPTION OF THE PREFERRED EMBODIMENT

Figure 1:
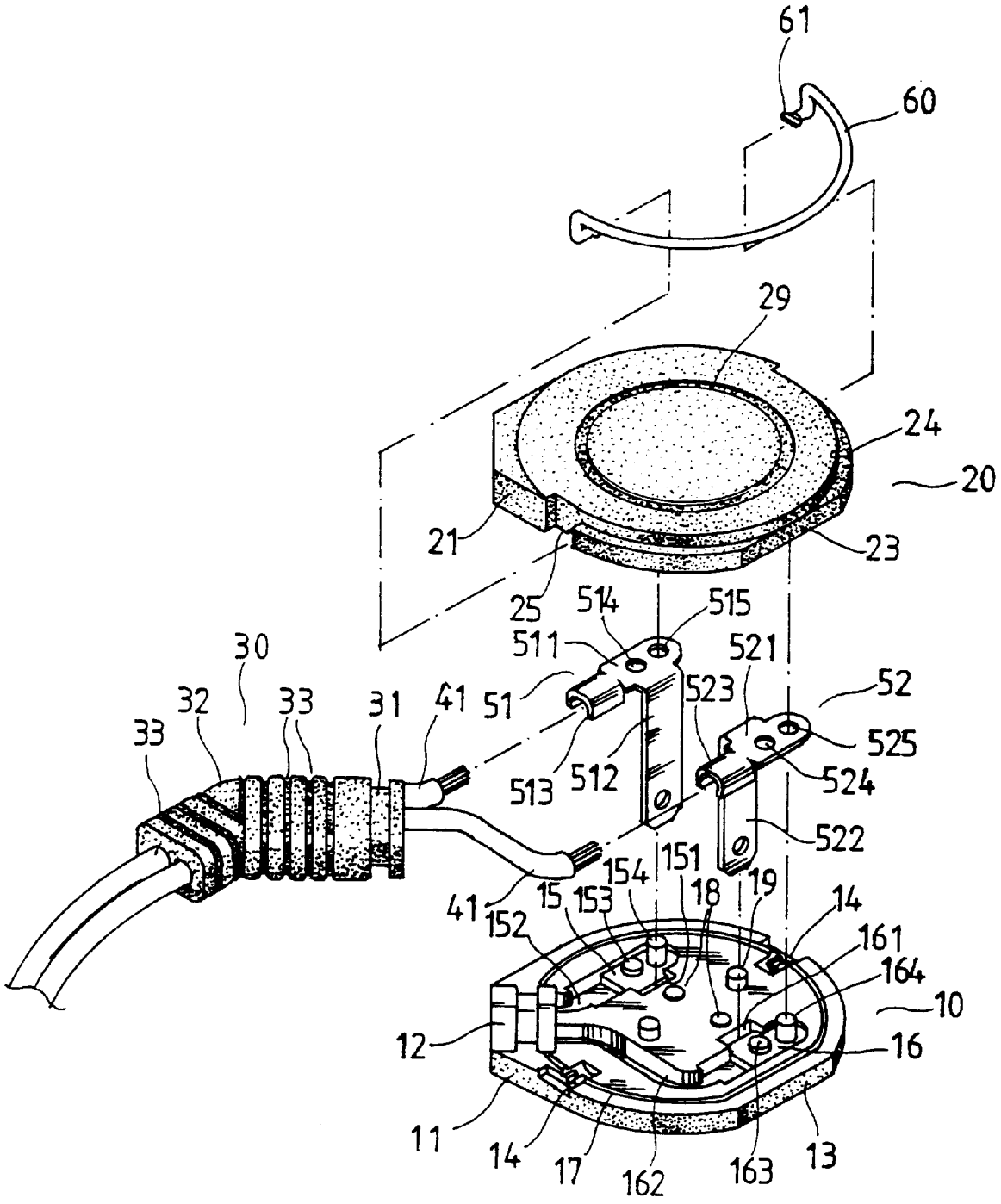
FIG. 1 is a perspective exploded view of a preferred embodiment of a flat plug structure according to the present invention.
Figure 2:
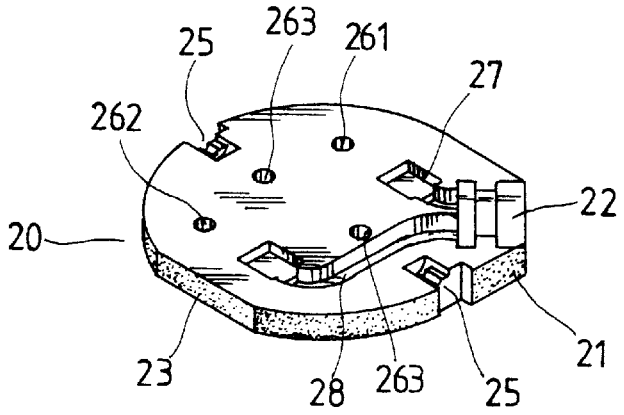
FIG. 2 is a perspective view of the reverse side of a cover of the preferred embodiment of FIG. 1.

With reference to FIGS. 1 and 2, a preferred embodiment of a flat plug according to the present invention comprises a base 10, a cover 20, a bent guide element 30, two electrical conductive insert pins 51, 52, and a semi-circular fastening ring 60.

Figure 3:
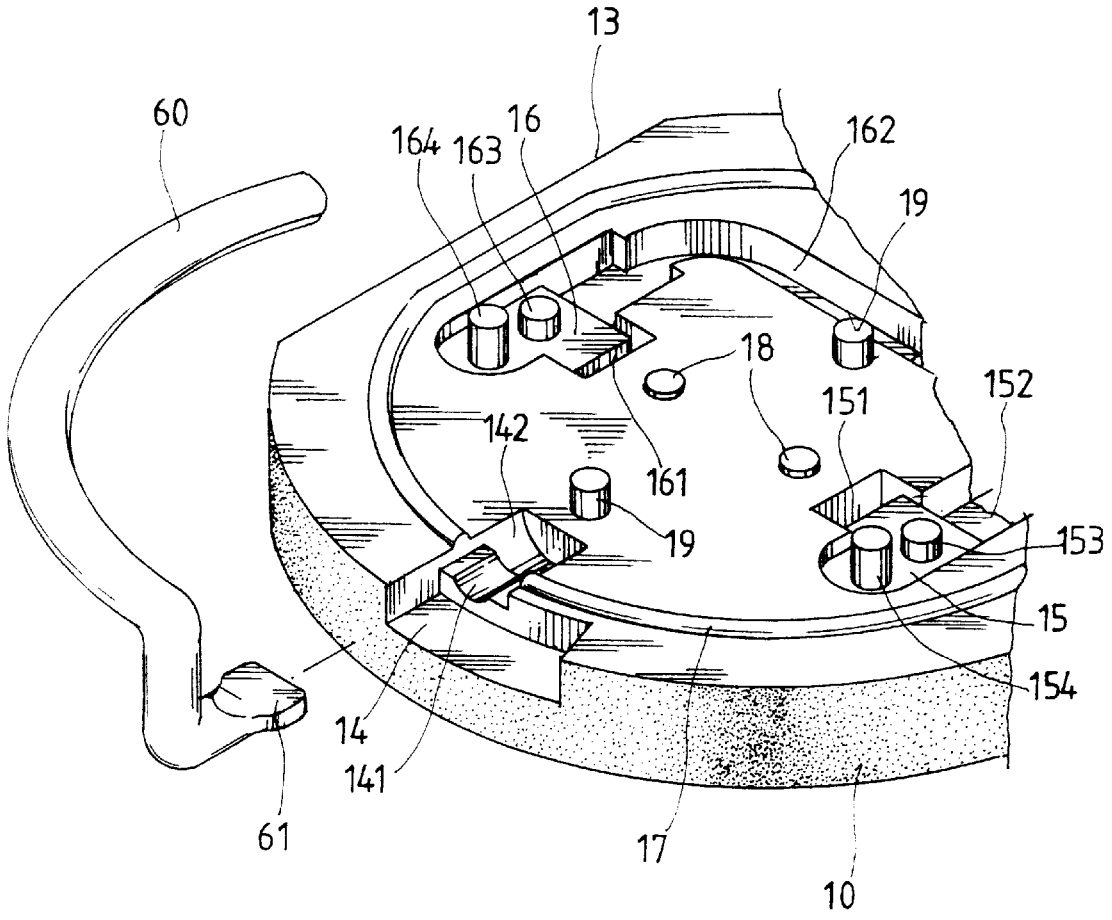
FIG. 3 is a perspective enlarged view of a base and a semi-circular fastening ring of the preferred embodiment of FIG. 1 in part.

The base 10 is substantially a circular plate, one side of which extends to form a tail portion 11 provided with an I-shaped groove 12 thereon. The base 10 is further provided with a cut planar face 13 opposite to the tail portion 11. The other two sides of the base 10 are respectively provided with a notch 14 at their edges. Referring to FIG. 3, the middle of the notch 14 includes a relatively small, semi-circular depression 141, and the inner portion of the notch 14 is a relatively large, semi-circular recess 142. The left and right sides of the base 10 are respectively provided with recessed portions 15, 16, each of which is provided with a through hole 151, 161 on the inner side thereof to extend to the bottom face of the base 10. The recessed portions 15, 16 further have rear grooves 152, 162 at rear ends thereof respectively. The rear grooves 152, 162 are relatively deep and extend to the I-shaped groove 12. A plurality of posts 153, 154, 163, 164 extend upwardly from the recessed portions 15, 16 respectively, in which posts 153, 163 are shorter whereas posts 154, 164 are longer. The base 10 further has short columns 18 and long columns 19 provided thereon. The edge of the base 10 is also provided with a slightly protruding ring 17.

The cover 20 resembles the base 10 in shape and is likewise a circular plate. One side of the cover 20 extends to form a tail portion 21 provided with an I-shaped groove 22 (see FIG. 2). The edge of the cover 20 opposite to the tail portion 21 is provided with a cut planar portion 23, and a semi-circular depressed portion 24 along the periphery of the cut planar portion. The other two sides of the cover 20 are provided with indentations 25 that correspond to the notches 14 of the base 10. The face of the cover 20 is provided with cavities 261, 262, 263 that match the posts 154, 164 and column 19. The cover 20 may further be provided with recesses 27, 28 corresponding to the recessed portions 15, 16 of the base 10.

The bent guide element 30 is secured integrally with a wire 40. A front end of the bent guide element 30 is provided with an annular groove 31 that may just fit into the I-shaped grooves 12, 22 of the base 10 and the cover 20 so that the three are secured as a whole. A central portion 32 of the bent guide element 30 is bent about 45 degrees and is provided with a determined number of annular grooves 33 to enhance its suppleness.

Figure 4:
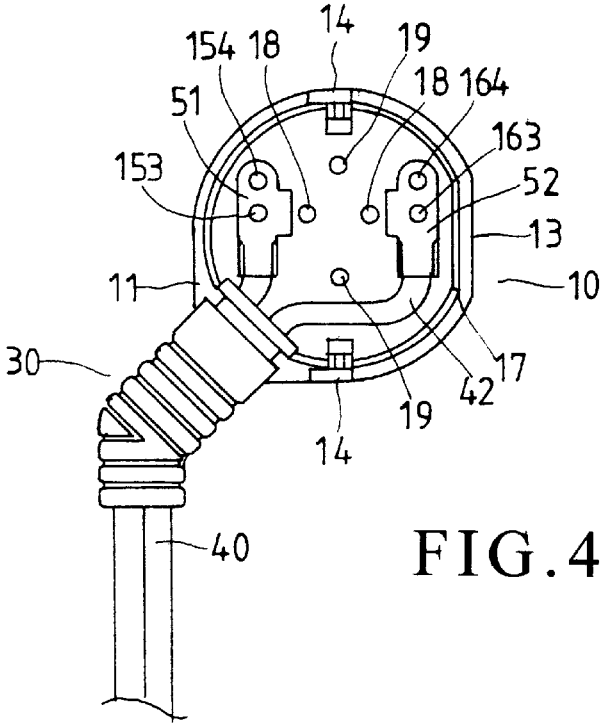
FIG. 4 is a plan schematic view of the preferred embodiment of FIG. 1 in which the cover is not put in position.

The two electrical conductive insert pins 51, 52 are punched and bent from steel sheets and include a horizontal plate portion 511, 521, a downwardly bent vertical pin portion 512, 522, and a wire securing seat 513, 523 that extends downwardly from a rear end of the horizontal plate portion 511, 521 to secure two rear wire ends 41, 42 of the wire 40. The horizontal plate portions 511, 521 are respectively provided with two holes 514, 515 and 524, 525. The two electrical conductive insert pins 51, 52 may just fit into the two recessed portions 15, 16 of the base 10 respectively such that the vertical pin portions 512, 522 respectively pass through the through holes 151, 161 of the base 10 with the posts 153, 154 and 163, 164 respectively passing through holes 514, 515 and 524, 525 of the horizontal plate portions 511, 521. By means of the holes that receive the posts, the two electrical conductive insert pins 51, 52 can be secured on the base 10, and the rear wire ends 41, 42 are respectively embedded in the rear grooves 162, 162 between the recessed portions 15, 16 and the I-shaped groove 12. Hence, prior to fusion of the cover 20 and the base 10 using high frequencies, the two electrical conductive insert pins 51, 52, the bent guide element 30, and the two rear wire ends 41, 42 can be positioned (as shown in FIG. 4) to facilitate the fusion process.

The semi-circular fastening ring 60 has two ends bending inwardly to form flat portions at rear ends 61. After the base 10, the cover 20, and the bent guide element 30 are fused together as a whole using high frequencies, the two ends of the fastening ring 60 can be inserted into the holes defined by the notches 14, 25 on both sides of the base 10 and the cover 20, thus achieving a flat plug.

Figure 5:
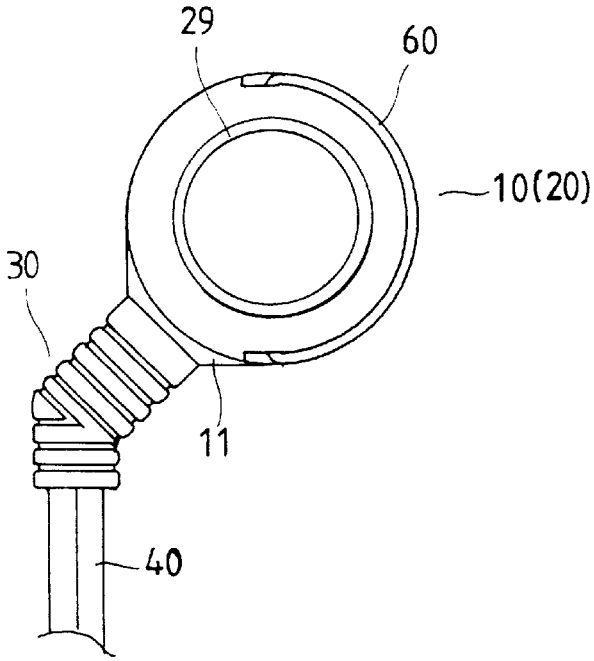
FIG. 5 is a plan bottom view of the preferred embodiment of FIG. 1.
Figure 6:
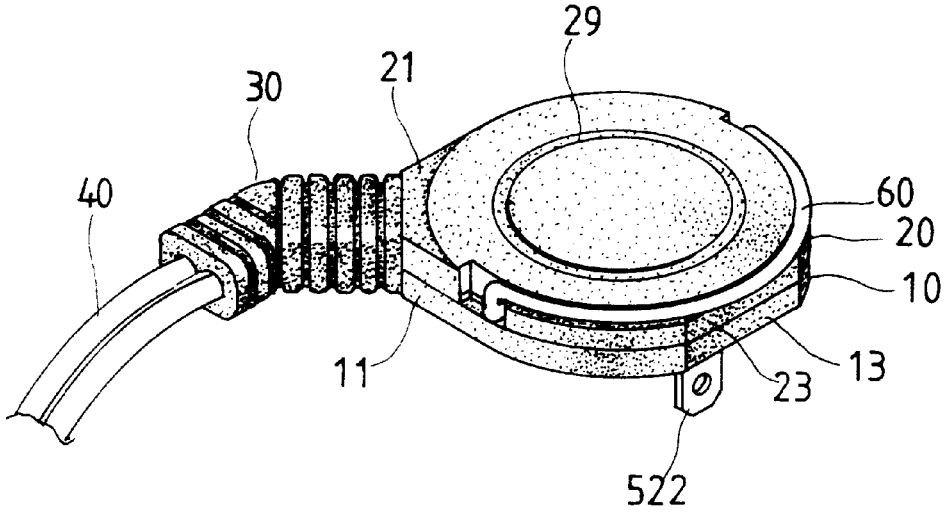
FIG. 6 is a perspective schematic view of the flat plug structure of the present invention, in which the fastening ring is received at the edge of the cover when not in use.
Figure 7:
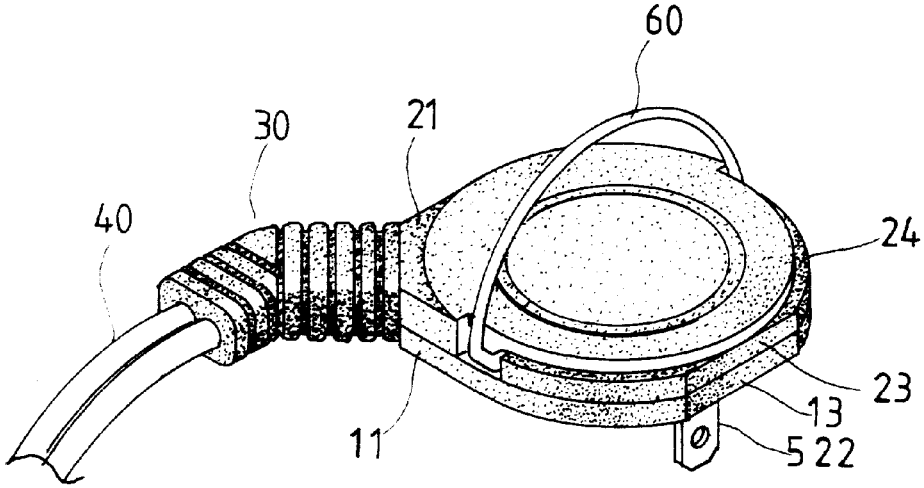
FIG. 7 is a perspective schematic view of the flat plug structure of the present invention, in which the fastening ring is lifted about 90 degrees.
Figure 9:
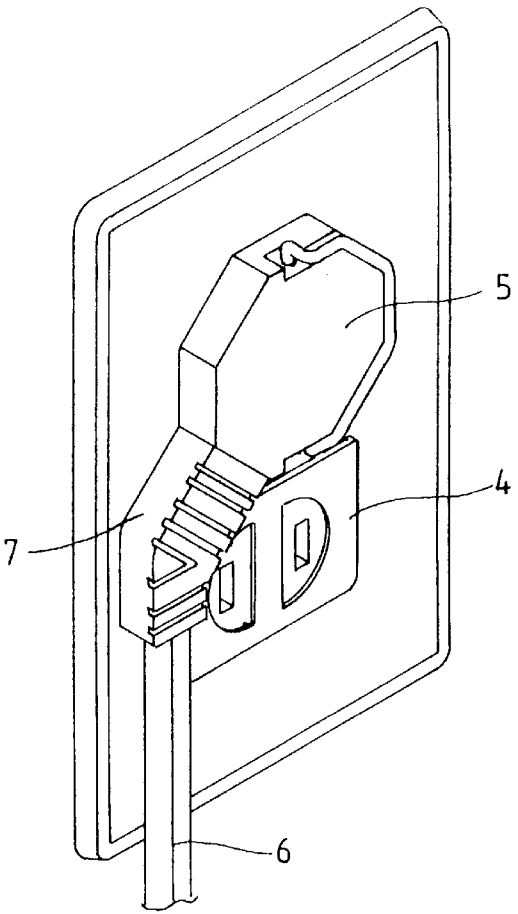
FIG. 9 is a perspective view of a conventional flat plug.
Figure 8:
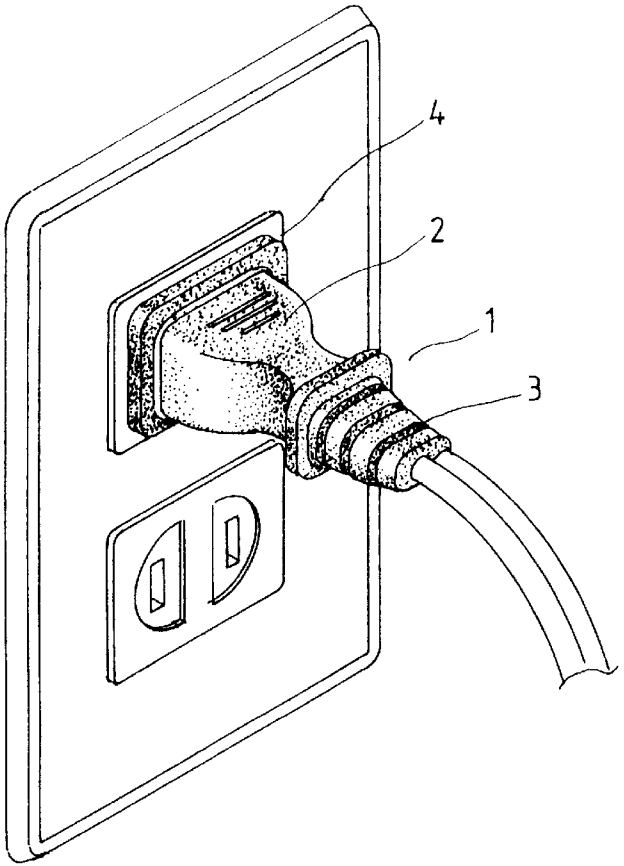
FIG. 8 is a perspective view of a conventional plug.

Referring to FIGS. 5 and 6, when not in use, the semi-circular fastening ring 60 is received in the semi-circular depressed portion 24 at the edge of the cover 20. When in use, referring to FIG. 7, the fastening ring 60 is lifted about 90 degrees to facilitate the user's pulling of the flat plug from the socket.

It should be appreciated that, unlike the prior art in which the plug is made by plastic extrusion, the flat plug of the present invention comprises the plastic injection molded base 10 and cover 20, and the extruded bent guide element 30. Although it appears that the structure of the flat plug of the present invention is more complicated than that of the prior art, the method of production is simplified and the production speed is increased. The reason is that the base 10 and the cover 20 according to the present invention can be mass-produced. Although the bent guide element 30 is extruded, since it is provided to envelop the wire 40, the production thereof is also very fast. Therefore, as a whole, the present invention is superior to the prior art in terms of production speed. In particular, no production bottleneck will be encountered during the production process as in the prior art. Furthermore, the base 10 and the cover 20 are preferably to be made into thin plate structures, and in order to avoid deformation and to enhance their structural strength, the cover 20 may be provided with a projecting or recessed ring 29 as shown in the drawings.

The base 10 or the cover 20 may be provided with a suitable number of fusion points so that they may be firmly fused together.

Although the present invention has been illustrated and described with reference to the preferred embodiment thereof, it should be understood that it is in no way limited to the details of such embodiment but is capable of numerous modifications within the scope of the appended claims.

What is claimed is:

1. A flat plug structure, comprising:

a base that is a substantially circular plate, the base has at least four sides, one of the sides of said base extending to form a tail portion provided with an I-shaped groove, the opposite side being provided with a cut planar face, and the other two sides being respectively provided with a notch at an edge thereof, said notch including a relatively small semi-circular depression in a middle portion thereof, and a relatively large semi-circular depression recess at an inner side thereof, said base further having recessed portion on both sides thereof, said recessed portions each being provided with a through hole on an inner side thereof, one of said recessed portions being deeper than the other and extending to said I-shaped groove, a plurality of posts extending upwardly from said recessed portions, the edge of said base being further provided with a slightly projecting ring;

a cover that is a substantially circular plate resembling the profile of said base, the cover has at least four sides, a first side of said cover extending to form a tail portion provided with an I-shaped groove, the opposite side being provided with a cut planar face at an edge thereof and a depressed portion along a periphery of said cut planar portion, the two other sides of said cover being provided with notches that are symmetrical with those of said base, a face of said cover having cavities disposed therein to match said posts of said base;

a bent guide element that is secured with a wire integrally, the bent guide element initially being detached from the base and cover, said bent guide element having a front end provided with an annular groove fittable into said I-shaped grooves of said base and said cover so that they can be secured as a whole, a central portion of said bent guide element being bent about 45 degrees and provided with a determined number of annular grooves to enhance its suppleness;

two electrical conductive insert pins that are punched and bent from steel sheets, said electrical conductive insert pins each including a horizontal plate portion, a downwardly bent vertical pin portion, and a wire securing seat, said horizontal plate portions being respectively provided with holes, said electrical conductive insert pins just fitting into said two recessed portions of said base respectively such that said vertical pin portions respectively pass through said through holes of said base with said posts respectively passing through holes of said horizontal plate portions, said wire being embedded in said deeper grooves between said recessed portions and said I-shaped groove of said base; and a semi-circular fastening ring that has two ends bending inwardly to form flat portions at rear ends thereof, said two ends being inserted into said holes defined by said notches on both sides of said base and said cover after said base, said cover, and said bent guide element are fused together as a whole using high frequencies, thus achieving a flat plug.

2. The flat plug structure as defined in claim 1, wherein said base or said cover may be provided with a suitable number of fusion points so that said cover and said base may be firmly fused together.

3. The flat plug as defined in claim 1, wherein said cover is provided with at least one projecting or depressed ring to enhance the structural strength thereof and avoid possible deformation thereof.

* * * * *